US005213044A

United States Patent [19]

Elia et al.

[11] Patent Number: 5,213,044

[45] Date of Patent: May 25, 1993

[54] METHOD AND APPARATUS FOR USE IN PRINTING

[75] Inventors: Frederick J. Elia, Sarasota, Fla.; Giacinto R. Mazzenga, Lake Como, Pa.

[73] Assignee: Como Technologies, Incorporated, Sarasota, Fla.

[21] Appl. No.: 621,296

[22] Filed: Nov. 30, 1990

[51] Int. Cl.[5] ..... B41M 1/00

[52] U.S. Cl. ..... 101/483; 101/366; 101/424; 101/425

[58] Field of Search ..... 101/364, 366, 424, 425, 101/483, 484, 348-352; 118/203, 302

[56] References Cited

U.S. PATENT DOCUMENTS

| | | | |
|---|---|---|---|
| 1,185,668 | 6/1916 | Hoe | 101/366 |
| 3,168,872 | 2/1965 | Pinkerton | 103/157 |
| 3,366,051 | 1/1968 | Fusco | 101/365 |
| 3,974,768 | 8/1976 | Grobman | 101/366 X |
| 4,369,734 | 1/1983 | Preuss | 101/425 X |
| 4,461,209 | 7/1984 | Washchynsky et al. | 101/219 |
| 4,680,696 | 7/1987 | Ebinuma et al. | 346/75 |
| 4,761,120 | 8/1988 | Mayer et al. | 417/403 |
| 5,003,877 | 4/1991 | Yano et al. | 101/425 X |
| 5,099,758 | 3/1992 | Hassler et al. | 101/120 |

*Primary Examiner*—Edgar S. Burr
*Assistant Examiner*—Christopher A. Bennett
*Attorney, Agent, or Firm*—Tarolli, Sundheim & Covell

[57] ABSTRACT

During a printing operation, an ink pump assembly is driven in a forward direction by a reversible electric motor to pump ink from a source of ink to an inker apparatus. When the printing operation has been almost completed, the direction of operation of the ink pump assembly is reversed to pump reusable ink back to the source of ink. When most of the reusable ink has been pumped back to the source of ink, a valve is actuated to direct the output from the reverse operating ink pump assembly to a waste material receiver. Once the ink has been pumped from the inker apparatus, a valve is actuated to connect the ink pump assembly in fluid communication with a source of clean-up fluid. The clean-up fluid is then pumped from the source to the inker apparatus by forward operation of the ink pump assembly. Once sufficient clean-up fluid has been conducted to the inker apparatus, the ink pump assembly is again connected with the waste material receiver. The ink pump assembly is again operated in the reverse direction to pump clean-up fluid pumped from the inker apparatus to the waste material receiver.

8 Claims, 4 Drawing Sheets

METHOD AND APPARATUS FOR USE IN PRINTING

BACKGROUND OF THE INVENTION

The present invention relates to a new and improved method and apparatus for use in printing with ink and more specifically for use in cleaning an inker apparatus toward the end of a printing operation.

A method and apparatus for use in cleaning an inker apparatus is disclosed in U.S. Pat. No. 1,185,668. When the inker apparatus disclosed in this patent is to be cleaned, an intake to an ink pump assembly is connected in communication with the atmosphere. Continued operation of the ink pump assembly then expels excess ink from the inker apparatus back to a tank or reservoir.

The intake to the ink pump assembly of this known apparatus is then connected in communication with a source of clean-up fluid, that is, with a tank of benzin. Continued operation of the ink pump assembly causes the clean-up fluid to flow through the inker apparatus to dissolve and remove hard or caked deposits of ink in the inker apparatus. The clean-up fluid, with the dissolved ink, is returned to the source of clean-up fluid.

SUMMARY OF THE INVENTION

The present invention provides a new and improved method and apparatus for use in a printing press which prints with ink. During a printing operation, an ink pump assembly is operated in a forward direction to pump ink to an inker apparatus. After at least substantially completing the printing operation, the direction of operation of the ink pump assembly is reversed to pump ink from the inker apparatus. Reusable ink pumped from the inker apparatus may be pumped back to the source of ink. However, defective ink pumped from the inker apparatus is preferably directed to a waste material receiver.

After the ink has been pumped from the inker apparatus by the ink pump assembly, the ink pump assembly is connected in communication with a source of clean-up fluid. The ink pump assembly is again operated in the forward direction to pump clean-up fluid to the inker apparatus. While clean-up fluid is being pumped to the inker apparatus, form rollers may be thrown on to transfer the clean-up fluid from the inker apparatus to other rolls of the printing press.

Thereafter, if the form rollers were previously thrown on to transfer clean-up fluid, the form rollers are thrown off and the pres is stopped. The direction of operation of the ink pump assembly is then reversed to pump clean-up fluid from the inker apparatus to the waste material receiver. After the excess clean-up fluid has been pumped from the inker apparatus by reverse operation of the ink pump assembly, operation of the ink pump assembly is stopped. The cleaned inker apparatus is then ready to receive ink upon subsequent initiation of a printing operation.

BRIEF DESCRIPTION OF THE DRAWINGS

The foregoing and other features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
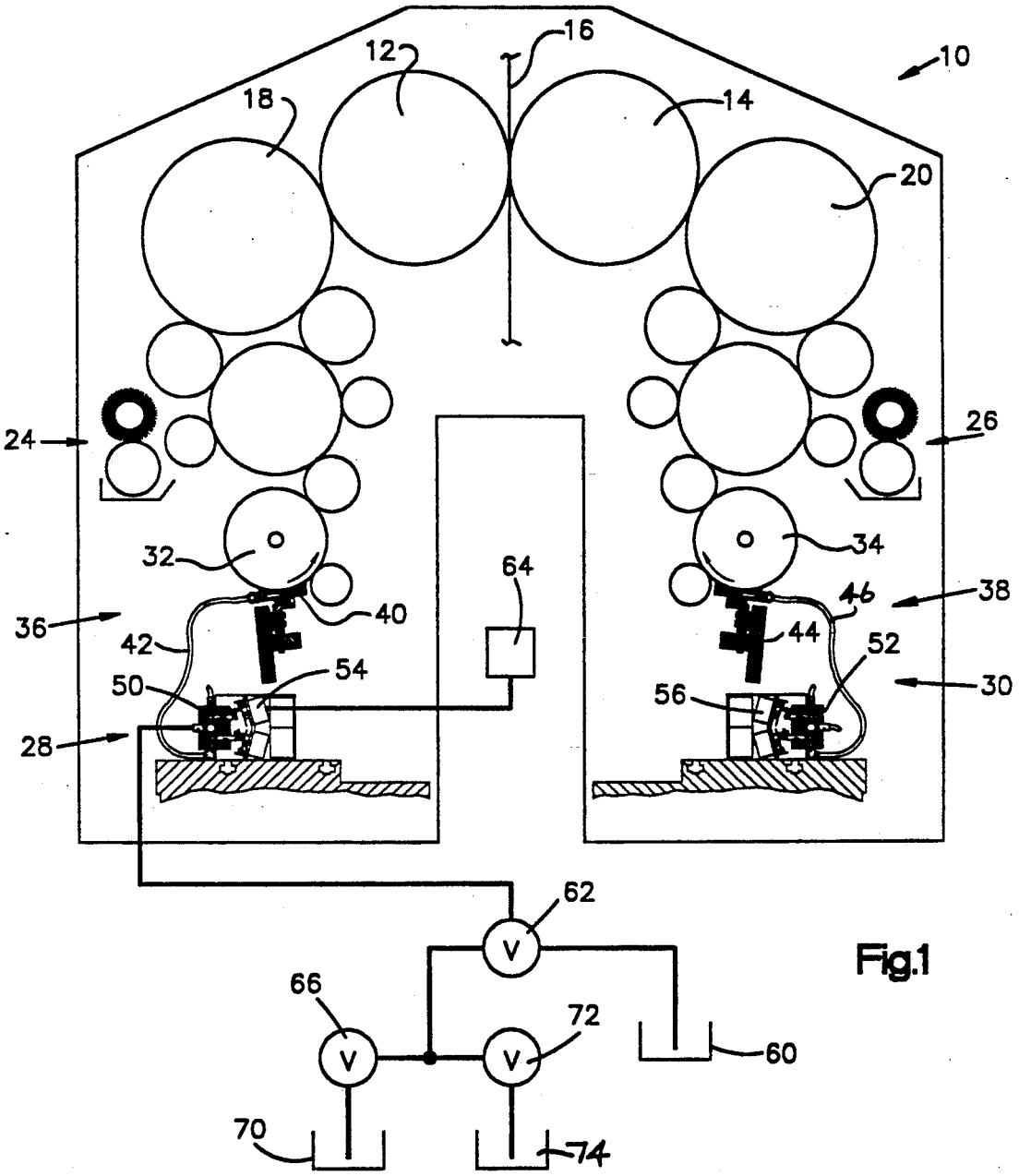
FIG. 1 is a schematic illustration of a printing press having a plurality of ink pump assemblies which are operated to clean a plurality of inker apparatus toward the end of a printing operation.

An offset lithographic printing press 10 of a generally known construction is illustrated schematically in FIG. 1. The printing press 10 includes a pair of blanket rolls 12 and 14 which print on opposite sides of a sheet material web 16 during operation of the printing press. An ink image is transferred to the blanket rolls 12 and 14 by a pair of plate rolls 18 and 20.

To provide for the formation of an ink image on the plate rolls 18 and 20, water or other dampening solution is supplied to the plate rolls by dampener assemblies 24 and 26. Ink is applied to the surface of the plate rolls 18 and 20 by identical inker assemblies 28 and 30. Thus, during operation of the printing press, ink is applied to the ink transfer rolls 32 and 34 by inker apparatus 36 and 38.

The inker apparatus 36 includes an ink rail 40 and conduit 42. Similarly, the inker apparatus 38 includes an ink rail 44 and a conduit 46. The inker apparatus 36 and 38 are supplied with ink by ink pump assemblies 50 and 52. The ink pump assemblies 50 and 52 are driven by reversible electric motors 54 and 56. It should be understood that each ink rail 40 or 44 is supplied with ink by a plurality of identical ink pump assemblies 50 or 52 driven by identical reversible electric motors 54 or 56. Thus, each ink rail 40 or 44 may be supplied with ink by eight or ten ink pump assemblies 50 each of which is driven by a motor 54.

Although it is preferred to use inker assemblies 28 and 30 constructed and operated in accordance with the present invention in an offset lithographic printing press, it should be understood that the inker assemblies could be associated with a different type of printing press if desired. The printing press 10 may print on the web 16 or may be of the sheet fed type. In addition, a different type of inker apparatus 36 could be used. Thus, rather than using the ink rail 40 to apply ink to the roll 32, ink could be sprayed onto the roll or directly onto the plate roll if desired. Thus, it should be understood that the invention is not to be considered as being limited to use in any particular type of printing press.

The electric motors 54 and 56 (FIG. 1) may advantageously be reversible, variable speed stepper type electric motors. The electric motors 54 and 56 are connected with the ink pump assemblies 50 and 52 by suitable drive assemblies. The construction and mode of operation of the ink pump assemblies 50 and 52, drive assemblies, and electric motors 54 and 56 are advantageously the same as is described in co-pending U.S. patent application Ser. No. 605,571, filed Oct. 30, 1990, by Giacinto R. Mazzenga and Frederick J. Elia and entitled "Printing Press Ink Supply System", and assigned to the Como Technologies, Inc. The general construction of the ink pump assemblies 50 and 52 and associated drive assemblies ar also similar to the construction of the ink pump assemblies and drive assemblies disclosed in U.S. Pat. No. 3,366,051 and U.S. Pat. No. 3,168,872. However, it is contemplated that other known types of ink pump assemblies and drive assemblies could be utilized if desired.

During operation of the printing press 10 (FIG. 1), the ink pump assembly 50 is operated in a forward direction to pump ink from a source or reservoir 60 of ink through a control valve 62 to the inker apparatus 36. Ink is transferred from the inker apparatus 36 to the ink transfer roll 32. Ink is transferred from the ink transfer roll 32 to the plate and blanket rolls 18 and 12 and to the web 16 or other sheet material. After at least substantially completing the printing with ink on the web 16, clean-up of the inker apparatus 36 and ink pump assembly 50 is initiated. The clean-up process may advantageously be initiated very shortly before the end of the printing operation to enable the ink on the various rolls between the web 16 and inker apparatus 36 to be used.

Upon initiation of the clean-up process, controls 64 reverse the direction of operation of the motor 54. This reverses the direction of operation of the pump assembly 50 to pump reusable ink from the inker apparatus 36 through the pump assembly and valve 62 to the source 60 of ink. When most of the reusable ink has been pumped from the inker apparatus 36 to the source 60 of ink, the valve 62 is actuated to block the flow of ink to the source 60. A second control valve 66 is then opened to enable ink to flow from the pump assembly 50 through the valve 62 and valve 66 to a waste material receiver or tank 70. Once the control valves 62 and 66 have been actuated, continued operation of the ink pump assembly 50 in the reverse direction pumps defective ink, that is ink which, for the most part, is not suitable for reuse, to the waste material receiver 70. Of course, if desired, all of the ink from the inker apparatus 36 could be pumped to the waste material receiver 70.

Once all of the ink possible has been pumped from the inker apparatus 36 (FIG. 1), the control valve 66 is closed and a control valve 72 is opened to enable clean-up fluid to be pumped from a source or tank 74 of clean-up fluid. At the same time, the direction of operation of the motor 54 and ink pump assembly 50 is reversed by the controls 64. The ink pump assembly 50 is then driven in a forward direction by the motor 54. This pumps clean-up fluid from the source 74 through the open valves 72 and 62 to the ink pump assembly 50. The clean-up fluid flows from the ink pump assembly 50 to the inker apparatus 36. Although many different types of clean-up fluids may be utilized if desired, it is believed that it may be particularly advantageous to use either soybean oil or linseed oil as the clean-up fluid.

The clean-up fluid is supplied to the ink transfer roll 32 (FIG. 1) by the ink rail 40. In addition, clean-up fluid is transferred to the various rolls of the printing press 10, including the plate roll 18 and blanket roll 12. This results in a printing-off of clean-up fluid on a waste portion of the web 16 while coating the various rolls of the printing press with the clean-up fluid. The rolls of the printing press 10 are then thrown off and operation of the press is stopped.

The direction of operation of the pump assembly 50 and motor 54 are then reversed. The valve 72 is closed and the valve 66 is opened. Excess clean-up fluid is then pumped from the inker apparatus 36 to the waste material receiver 70 by reverse operation of the ink pump assembly 50.

The operation of the ink pump assembly 50 in the reverse direction is continued until all of the excess clean-up fluid 36 has been pumped from the inker apparatus 36. The operation of the electric motor 54 and ink pump assembly 50 is then stopped by the controls 64. After any clean-up fluid remaining in the lines has drained to the waste material receiver 70, the valve 66 is closed.

Control Apparatus

Figure 2:
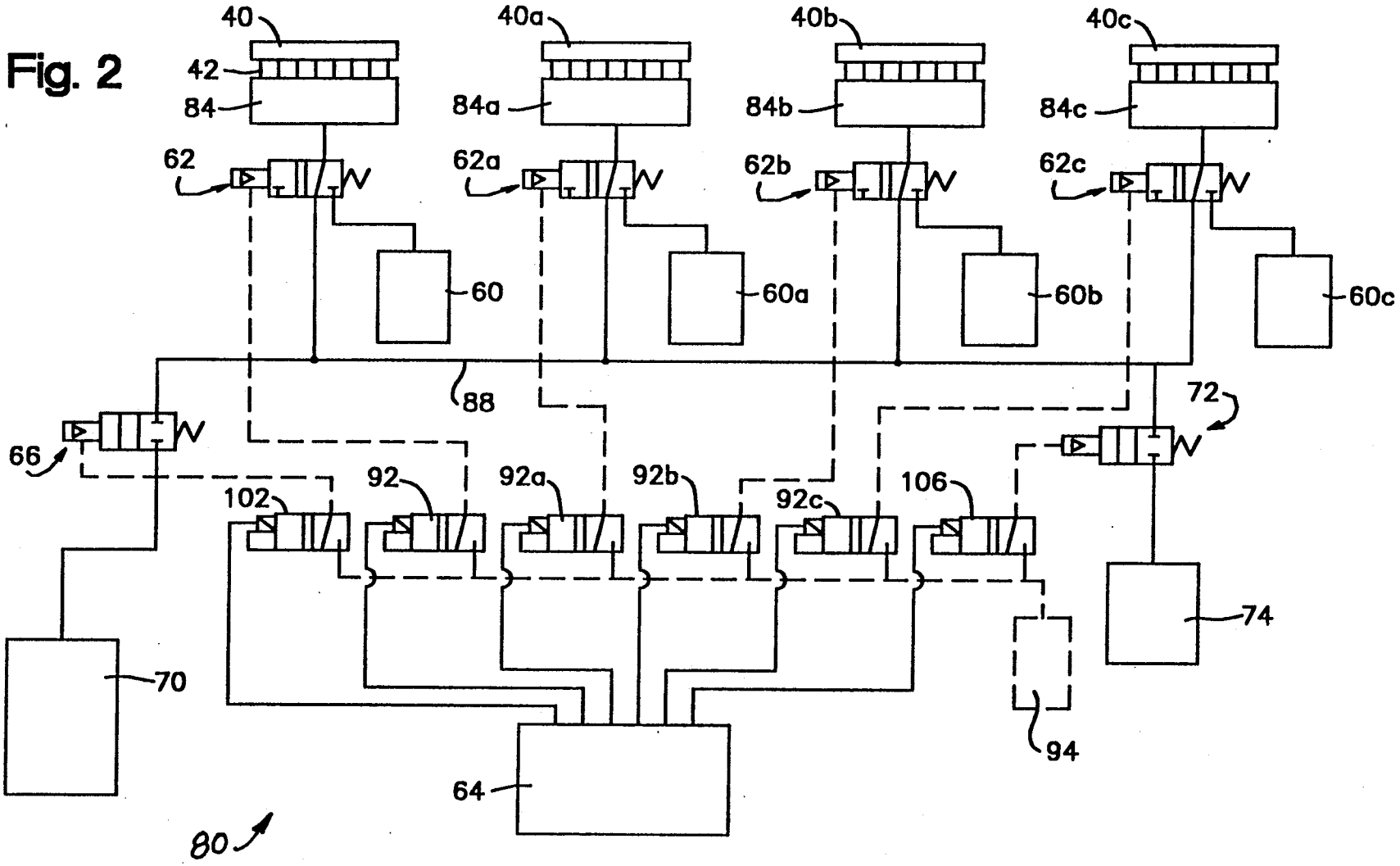
FIG. 2 is a schematic illustration depicting controls for selectively connecting ink pump assemblies in the printing press of FIG. 1 with sources of ink, a waste material receiver, and a source of clean-up fluid.

Apparatus 80 for controlling the flow of fluid to and from ink pump assemblies having the same construction as the ink pump assemblies 50 and 52, is illustrated in FIG. 2. Although only a single ink pump assembly 50 has been shown in association with the ink rail 40 in FIG. 1, it should be understood that there are a plurality of identical ink pump assemblies 50 connected with the ink rail 40 by identical conduits 42. In FIG. 2, the plurality of ink pump assemblies, specifically eight, are shown as an ink pump module 84.

Each of the identical ink pump assemblies 50 in the ink pump module 84 (FIG. 2) is connected with the ink rail 40 by a conduit 42. Similar ink pump modules **84*a*, 84*b*, and 84*c* are connected with similar ink rails 40*a*, 40*b*, and 40*c* in the same manner as in which the ink pump assemblies 50 in the ink pump module 84 are connected with the rail 40. It should be understood that the ink pump assemblies in all four of the ink pump modules 84, 84*a*, 84*b* and 84*c* have the same construction as the ink pump assembly 50 and are driven by identical reversible stepper type electric motors 54. There may be more or less than the four ink pump modules 84, 84*a*, 84*b* and 84*c* shown in FIG. 2 associated with the units of a printing press 10**.

Each of the ink pump assemblies 50 in the ink pump module 84 is connected with the control valve 62 in the manner previously explained in conjunction with FIG. 1. The control valve 62 (FIG. 2) is an air-piloted three-way, two-position, pressure operated, spring return valve. The three-way valve 62 is of the double diaphragm poppet type. In one specific embodiment of the invention, the three-way valve 62 was a Humphrey 250 Series air-piloted valve which is commercially available under the designation of 250A-3-10-20 from Humphrey Products Company of Kalamazoo, MI. Of course, other known types of valves could be used if desired.

When the three-way ink flow control valve 62 is i the unactuated condition shown in FIG. 2, the flow of ink to and from the source 60 is blocked by the valve 62. However, fluid can flow through the unactuated valve 62 between the pump module 84 and a plenum or manifold line 88. The manifold line 88 is connected in fluid communication with the valve 66 which controls fluid flow to the waste material receiving tank 70 and with the valve 72 which controls fluid flow from the clean-up fluid tank 74.

Operation of the valve 62 is controlled by a three-way pilot valve 92 which is connected in fluid communication with a source 94 of air under pressure. In one specific embodiment of the invention, the pilot valve 92 was a Humphrey Mini-Mizer three-way solenoid operated valve available from Humphrey Products Company of Kalamazoo, MI. Of course other known pilot valves could be utilized if desired. Operation of the solenoid actuated pilot valve 92 is controlled by the controls 64. In one specific instance, the controls 64 were an Intel 80286 Microprocessor.

Upon actuation of the pilot valve 92 by the control unit 64, high pressure air is directed to the valve 62 to operate the valve from the unactuated condition shown in FIG. 2 to an actuated condition in which the source of ink 60 is connected in fluid communication with the pump module 84. Upon operation of the pilot valve 92 back to the unactuated condition shown in FIG. 2 by the main control assembly 64, the three-way valve 62 is operated back to the unactuated condition shown in FIG. 2 under the influence of a biasing spring. Operation of three-way valves 62*a*, 62*b*, and 62*c* is controlled by pilot valves 92*a*, 92*b* and 92*c* in the same manner as previously explained in conjunction with the pilot valve 92.

When the two-way waste material flow control valve 66 is in the unactuated condition shown in FIG. 2, the valve blocks fluid flow between the manifold line 88 and the waste material receiving tank 70. Upon actuation of the valve 66, fluid can flow from the manifold line 88 to the waste material receiving tank 70. In one specific instance, the two-way control valve 66 was a 3-way valve which had been made into a 2-way valve by plugging an exhaust port. In this specific instance, the 3-way valve which was modified was a Humphrey Model 250A double diaphragm poppet valve which is available under the designation 250A-3-10-20 from the Humphrey Products Company, of Kalamazoo, MI. Of course, other known types of control valves could be used for the waste control valve 66 if desired.

A three-way solenoid operated pilot valve 102 is operable by the control assembly 64 to direct high pressure air from the source 94 to the waste control valve 66. This effects operation of the waste control valve 66 from the unactuated condition blocking fluid flow to the waste material receiving tank 70 to an actuated condition enabling fluid to flow to the waste material receiving tank. The pilot valve 102 is of the same construction as the pilot valve 92.

When the two-way clean-up flow control valve 72 is in the unactuated condition shown in FIG. 2, the valve blocks fluid flow between the clean-up fluid tank 74 and the manifold line 88. Upon actuation of the valve 72, clean-up fluid can flow from the tank 74 to the manifold line 88. In one specific instance, the two-way control valve 72 was a three-way valve which had been made into a two-way valve by plugging an exhaust port. In this specific instance, the three-way valve which was modified was a Humphrey Model 250A double diaphragm poppet valve which is commercially available under the designation 250A-3-10-20 from the Humphrey Products Company of Kalamazoo, MI. Of course, other known types of control valves could be used as the clean-up fluid flow control valve 72 if desired.

A three-way solenoid operated pilot valve 106 is operable by the control assembly 64 to direct high pressure air from the source 94 to the clean-up fluid control valve 72. This effects operation of the clean-up fluid flow control valve 72 from the unactuated condition blocking fluid flow to and from the clean-up fluid tank 74 to an actuated condition enabling fluid to flow from the clean-up fluid tank 74 to the manifold line 88. The pilot valve 106 is of the same construction as the pilot valve 92.

Operation

During a normal printing operation, the printing press 10 prints on opposite sides of the web 16 with ink. At this time, the ink flow control valve 62 is actuated to enable fluid to flow from the source 60 of ink (FIGS. 2 and 3) through the actuated three-way valve 62 to the ink pump assembly 50 in the pump module 84 (FIG. 2). Of course, the other ink flow control valves 62*a*, 62*b* and 62*c* are also actuated to enable ink to flow to the modules 84*a*, 84*b* and 84*c*.

Figure 3:
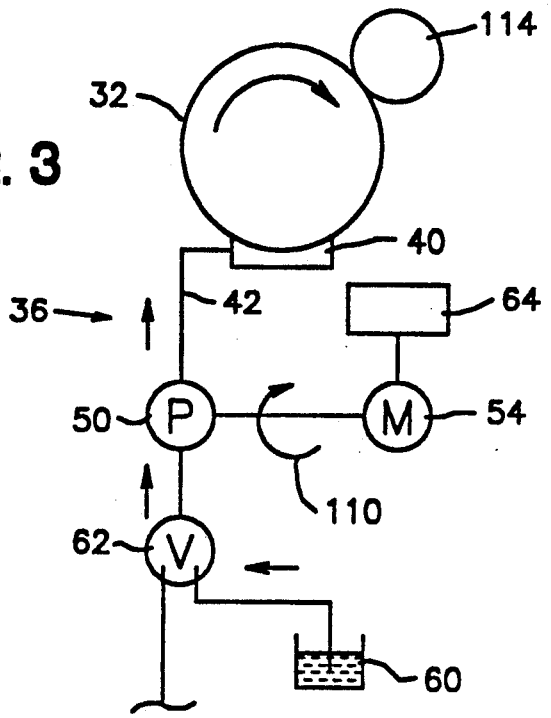
FIG. 3 is a simplified schematic illustration depicting the manner in which an ink pump assembly is operated in a forward direction to pump ink from a source of ink to an inker apparatus during operation of the printing press of FIG. 1.

Considering just the ink pump assembly 50, the controls 64 effect operation of the reversible electric motor 54 to drive the ink pump assembly 50 in a forward direction, that is in the direction indicated by the arrow 110 in FIG. 3. This results in a flow of ink from the source 60 through the actuated valve 62 and ink pump assembly 50 to the conduit 42 and ink rail 40 in the inker apparatus 36. The ink rail 40 applies ink to the transfer roll 32. Ink is conducted from the transfer roll 32 to the plate and blanket rolls 18 and 12 of the printing press 10 (FIG. 1).

When the printing operation is at least substantially completed, that is, when there is relatively small number of units to be printed on the web 16, for example, five newspapers, the controls 64 stop operation of the motor 54 and ink pump assembly 50. The direction of operation of the motor 54 is then reversed to reverse the direction of operation of the ink pump assembly 50, in the manner indicated by the arrow 112 in FIG. 4. After sufficient time has passed to print the remaining number of units, in the aforementioned example five papers, an ink transfer roll 114 is moved from its normal printing position in engagement with the roll 32 (FIG. 3) to a disengaged or thrown-off position (FIG. 4) in which the transfer roll is ineffective to conduct ink from the roll 32.

Figure 4:
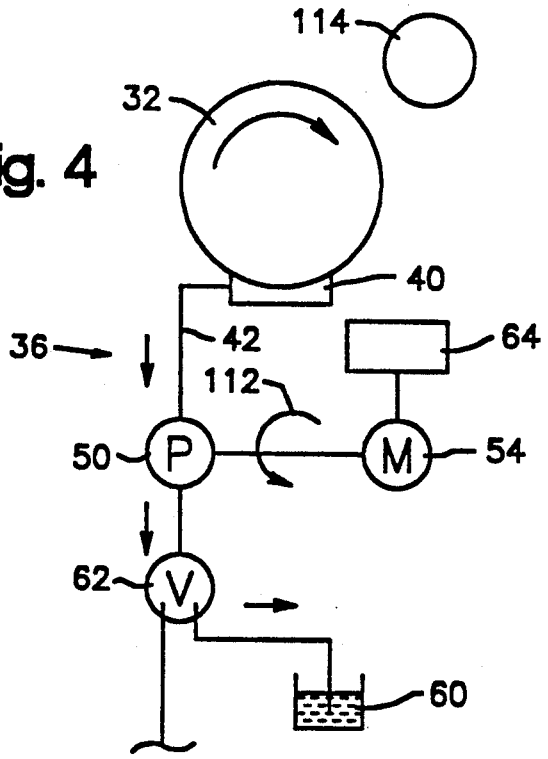
FIG. 4 is a schematic illustration, generally similar to FIG. 3, illustrating the manner in which the ink pump assembly is operated in a reverse direction to pump reusable ink from the inker apparatus back to the source of ink toward the end of a printing operation.

Operation of the ink pump assembly 50 in the reverse direction, as indicated by the arrow 112 in FIG. 4, pumps ink from the inker apparatus 36 through the actuated ink flow control valve 62 to the source 60 of ink. The flow of ink from the inker apparatus 36 to the source 60 of ink under the influence of the reverse operating pump 50 continues for a relatively short period of time, for example, about 4.5 second. During this time most of the reusable ink is pumped from the inker apparatus 36 back through the valve 62 to the source 60.

Figure 5:
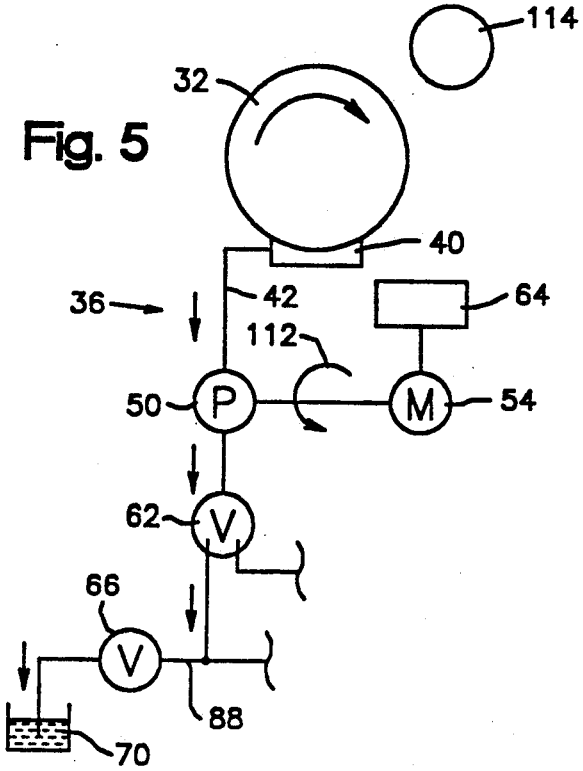
FIG. 5 is a schematic illustration, generally similar to FIG. 4, illustrating the manner in which the ink pump assembly continues to operate in the reverse direction to pump defective ink from the inker apparatus to a waste material receiver or tank.

When most of the reusable ink has been returned to the source 60, the flow control valve 62 is operated to the unactuated condition shown in FIGS. 2 and 5. In addition, the waste flow control valve 66 is actuated.

This enables ink to flow through the unactuated ink flow control valve 62 and actuated waste flow control valve 66 to the waste tank 70 (FIG. 5). Therefore, during continued operation of the ink pump assembly 50 in the reverse direction, indicated by tho arrow 112 in FIG. 5, substandard ink is pumped from the inker apparatus 36 to the waste material receiving tank 70. This operation of the ink pump assembly 50 to pump ink to the waste material receiving tank 70 is continued for a length of time sufficient to empty the inker apparatus 36 and ink pump assembly 50 of ink, in the example, this would be approximately eight seconds.

After all of the available ink has been pumped from the inker apparatus 36, the clean-up fluid control valve 72 (FIG. 2) is opened to enable clean-up fluid to flow from the tank 74. At the same time, the direction of operation of the motor 54 is reversed by the controls 64 to pump ink in a forward direction, indicated by the arrow 116 in FIG. 6. The waste flow control valve 66 (FIG. 2) is then closed.

Figure 6:
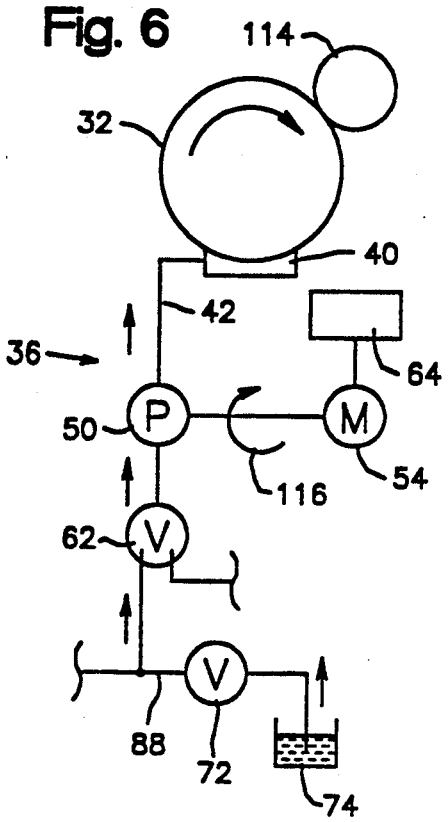
FIG. 6 is a schematic illustration, generally similar to FIG. 5, illustrating the manner in which the ink pump assembly is operated in a forward direction to pump clean-up fluid from a source of clean-up fluid to the inker apparatus.

The ink pump assembly 50 is operated in the forward direction, as indicated by the arrow 116 in FIG. 6, to pump clean-up fluid from the tank 74 to the inker apparatus 36. After a relatively short time, the inker apparatus 36 is filled with clean-up fluid and the rail 40 is effective to apply clean-up fluid to the ink transfer roll 42. After this short period of time, approximately two seconds, the ink transfer roll 114 is moved from the thrown-off position of FIG. 5 to the thrown-on position of FIG. 6.

When the ink transfer roll 114 is in the thrown-on position of FIG. 6, it is effective to transfer clean-up fluid from the ink roll 32 to other rolls, including the plate roll 18 and blanket roll 12, of the printing press. This results in clean-up fluid being printed off onto the web 16 from the blanket roll 12. After a short time, approximately four seconds, of printing clean-up solution on the web 16, the ink transfer roll 114 is moved back to the thrown-off position and the printing press is stopped.

Figure 7:
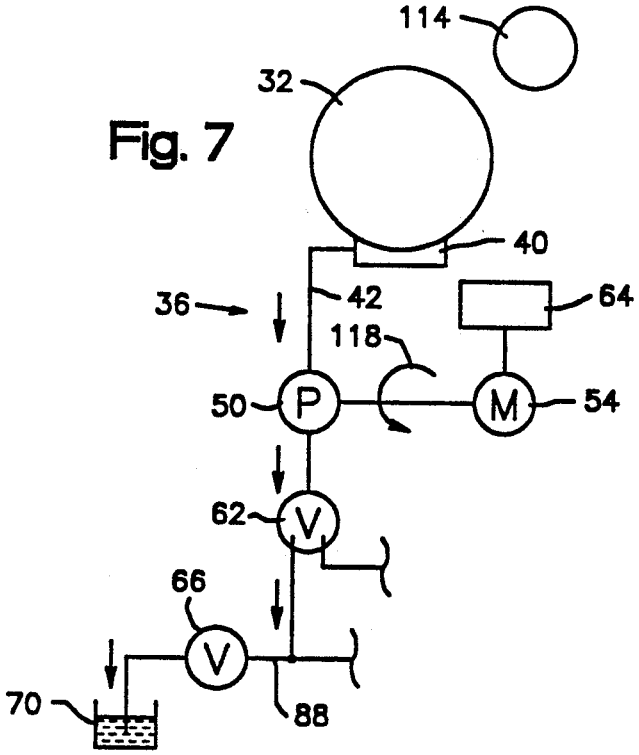
FIG. 7 is a schematic illustration, generally similar to FIG. 6, illustrating the manner in which the ink pump assembly is operated in the reverse direction to pump clean-up fluid from the inker apparatus to the waste material receiver.

At this time, the controls 64 change the direction of operation of the motor 54 to drive the ink pump assembly 50 in the reverse direction as indicated by the arrow 118 in FIG. 7. The clean-up fluid control valve 72 is returned to its normal unactuated or closed condition blocking fluid flow to and from the source 74 of clean-up fluid. At the same time, the waste material flow control valve 66 is actuated to an open condition to enable fluid to flow to the waste material receiving tank 70. The reverse operation of the ink pump assembly 50, indicated by the arrow 118 in FIG. 7, is continued until all excess clean-up fluid has been pumped from the inker apparatus 36 and the lines have drained. This may take approximately six or seven seconds of reverse operation of the ink pump assembly 50.

The controls 64 then stop operation of the motor 54 and the ink pump assembly 50. The waste flow control valve 66 is then returned to its closed position. At this time, the inker apparatus 36 will have been cleaned and the conduits will contain a residue of clean-up fluid. When the next printing operation is to be undertaken, the ink pump assembly 50 is operated in the forward direction with the ink flow control valve 62 in the open condition indicated schematically in FIG. 3. The initial flow of ink through the inker apparatus 36 and to the rolls of the printing press may be printed off on a wasted portion of the web in order to eliminate any residual clean-up solution. Normal printing operations will then be undertaken in the manner indicated schematically in FIG. 3.

Although the foregoing description in conjunction with FIGS. 3–7 of the drawings relates only to one of the ink pump assemblies 50, it should be understood that each of the plurality, specifically eight, ink pump assemblies in the pump module 84 are operated in the same manner and at the same time as the ink pump assembly 50. Of course, the ink pump assemblies in the other modules **84*a*, 84*b*, 84*c*, etc. would also be operated in the same manner as previously explained in conjunction with the ink pump assembly 50**.

The foregoing specific time durations for various steps during the operations illustrated schematically in FIGS. 3–7 have been set forth herein merely for purposes of clarity of description and not for purposes of limitation of the invention. Thus, it should be understood that the various steps in the operation could be undertaken for any desired length of time. In addition, it should be understood that although it is preferred to begin the clean-up operation before the last few units or newspapers have been printed on the web 16 in order to use ink on the various rolls of the printing press, the clean-up operation could be started after the last unit has been printed on the web 16 if desired.

Conclusion

In view of the foregoing description it is apparent that the present invention provides a new and improved method and apparatus for use in a printing press 10 which prints on sheet material 16 with ink. During a printing operation, an ink pump assembly 50 is operated in a forward direction (FIG. 3) to pump ink to an inker apparatus 36. After at least substantially completing the printing operation, the direction of operation of the ink pump assembly 50 is reversed (FIG. 4) to pump ink from the inker apparatus 36. Reusable ink pumped from the inker apparatus 36 may be pumped back to the source 60 of ink. However, defective ink pumped from the inker apparatus is preferably directed to a waste material receiver 70 (FIG. 5).

After the ink has been pumped from the inker apparatus 36 by the ink pump assembly 50, the ink pump assembly is connected in communication with a source 74 (FIG. 6) of clean-up fluid. The ink pump assembly 50 is again operated in the forward direction to pump clean-up fluid to the inker apparatus 36. While clean-up fluid is being pumped to the inker apparatus 36, form rollers 114 may be thrown on to transfer the clean-up fluid from the inker apparatus 36 to other rolls of the printing press.

Thereafter, if the form rollers 114 were previously thrown on to transfer clean-up fluid, the form rollers are thrown off and the press 10 is stopped. The direction of operation of the ink pump assembly 50 is then reversed (FIG. 7) to pump clean-up fluid from the inker apparatus 36 to the waste material receiver 70. After the excess cleanup fluid has been pumped from the inker apparatus 36 by reverse operation of the ink pump assembly 50, operation of the ink pump assembly is stopped. The cleaned inker apparatus 36 is then ready to receive ink upon subsequent initiation of a printing operation.

Having described one specific preferred embodiment the invention, the following is claimed:

1. A method comprising the steps of printing on sheet material with ink, operating an ink pump in a first direction to pump ink to an inker apparatus during performance of said step of printing on sheet material with ink, after at least substantially completing said step of printing on sheet material with ink, operating the ink pump in a second direction opposite to the first-direction to pump ink from the inker apparatus, operating the ink pump in the first direction to pump clean-up fluid to the inker apparatus after completing said step of operating the ink pump in the second direction to pump ink from the inker apparatus, and operating the ink pump in the second direction to pump clean-up fluid from the inker apparatus after completing said step of operating the ink pump in the first direction to pump clean-up fluid to the inker apparatus.

2. A method as set forth in claim 1 wherein said step of printing on sheet material with ink is partially performed while the ink pump is being operated in the second direction.

3. A method as set forth in claim 1 wherein said step of operating an ink pump in a first direction to pump ink to an inker apparatus includes the step of pumping ink from a source of ink, said step of operating the ink pump in a second direction opposite to the first direction to pump ink from the inker apparatus includes the steps of pumping ink back to the source of ink and then pumping ink to a location other than the source of ink.

4. A method as set forth in claim 1 further including the step of printing on sheet material with clean-up fluid after at least partially performing said step of operating the ink pump in the first direction to pump clean-up fluid to the inker apparatus.

5. An apparatus comprising inker means for applying ink to a roll of a printing press, an inker pump connected with said inker means, motor means for driving said ink pump in forward and reverse directions, control means for effecting operation of said motor means to drive said ink pump from a source of ink to said inker means and for effecting operation of said motor means to drive said ink pump in a reverse direction to pump ink from said inker means, means for holding body of clean-up fluid, means for receiving fluid, and valve means operable between a first condition connecting said ink pump in fluid communication with the source of ink, a second condition connecting said ink pump in fluid communication with said means for receiving fluid and a third condition connecting said ink pump in fluid communication with said means for holding a body of clean-up fluid, said control means including means for effecting operation of said motor means to drive said ink pump in a forward direction when said valve means is in the first or third condition and for effecting operation of said motor means to drive said ink pump in the reverse direction when said valve means is in the second condition.

6. A method comprising the step of printing on sheet material with ink, operating an ink pump in a first direction to pump ink from a source of ink to an inker apparatus during performance of said step of printing on sheet material with ink, after at least substantially completing said step of printing on sheet material with ink, operating the ink pump in a second direction opposite to the first direction to pump ink from the inker apparatus, conducting an initial portion of the ink pumped from the inker apparatus during operation of the ink pump in the second direction back to the source of ink, thereafter, conducting ink pumped from the inker apparatus during operation of the ink pump in the second direction to a location other than the source of ink, thereafter, operating the ink pump in the first direction to pump clean-up fluid to the inker apparatus, and thereafter, operating the ink pump in the second direction to pump clean-up fluid from the inker apparatus.

7. A method as set forth in claim 6 wherein said step of printing on sheet material with ink is partially performed during performance of said step of operating the ink pump in a second direction to pump ink from the inker apparatus.

8. A method as set forth in claim 6 further including the step of printing on sheet material with clean-up fluid after at least partially performing said step of operating the ink pump in the first direction to pump clean-up fluid to the inker apparatus.

* * * * *